US009142164B2

(12) United States Patent
Oda

(10) Patent No.: US 9,142,164 B2
(45) Date of Patent: Sep. 22, 2015

(54) VIDEO DISPLAY DEVICE

(71) Applicant: SHARP KABUSHIKI KAISHA, Osaka-shi, Osaka (JP)

(72) Inventor: Eishi Oda, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 0 days.

(21) Appl. No.: 14/263,800

(22) Filed: Apr. 28, 2014

(65) Prior Publication Data

US 2014/0232760 A1 Aug. 21, 2014

Related U.S. Application Data

(62) Division of application No. 14/004,864, filed as application No. PCT/JP2012/056224 on Mar. 12, 2012, now Pat. No. 8,749,473.

(30) Foreign Application Priority Data

Mar. 15, 2011 (JP) ..... 2011-056355
Mar. 15, 2011 (JP) ..... 2011-056359

(51) Int. Cl.
*G09G 3/34* (2006.01)
*G09G 3/36* (2006.01)

(52) U.S. Cl.
CPC ..... *G09G 3/3406* (2013.01); *G09G 3/3426* (2013.01); *G09G 3/3648* (2013.01); (Continued)

(58) Field of Classification Search
CPC . G09G 3/3406; G09G 3/3648; G09G 3/3426; G09G 2320/066; G09G 2330/023; G09G 2320/0626; G09G 2330/021; G09G 2360/16; G09G 2320/0238; G09G 2320/0646; G09G 2320/064
USPC ..... 345/102
See application file for complete search history.

(56) References Cited

U.S. PATENT DOCUMENTS 7,825,893 B2 11/2010 Oka et al.
2009/0207193 A1 8/2009 Isobe et al.

(Continued)

FOREIGN PATENT DOCUMENTS

JP 2002-099250 A 4/2002
JP 2007-140436 A 6/2007

(Continued)

OTHER PUBLICATIONS

Notice of Allowance mailed Jan. 30, 2014 for U.S. Appl. No. 14/004,864.

*Primary Examiner* — Lun-Yi Lao
*Assistant Examiner* — Ibrahim Khan
(74) *Attorney, Agent, or Firm* — Birch, Stewart, Kolasch & Birch, LLP

(57) ABSTRACT

The present invention causes noise in a low-luminance portion to become less prominent when a backlight is divided into a plurality of regions and the luminance of the backlight is controlled in accordance with a video signal corresponding to each of the regions. An area active control portion (2) divides a video signal into a plurality of regions and outputs a first feature amount for every region. An LED control portion (3) determines a first luminance for each of the divided regions of an LED backlight (5) in accordance with the first feature amount of every region. Within a range where the total value of an LED drive current is no greater than a predetermined allowable current value, a magnification constant is uniformly multiplied by the first luminance to determine a second luminance. The second luminance and a threshold value are compared, and, only with respect to those regions where the second luminance is lower than the threshold value, the second luminance is again lowered to make a third luminance. The third luminance and also the second luminance of the regions where the second luminance has not been lowered are used to control the LED light emission in each of the divided regions.

11 Claims, 12 Drawing Sheets

(52) U.S. Cl.
CPC .. *G09G2320/0238* (2013.01); *G09G 2320/064* (2013.01); *G09G 2320/066* (2013.01); *G09G 2320/0626* (2013.01); *G09G 2320/0646* (2013.01); *G09G 2330/021* (2013.01); *G09G 2330/023* (2013.01); *G09G 2360/16* (2013.01)

(56) References Cited

U.S. PATENT DOCUMENTS

| | | | | |
|---|---|---|---|---|
| 2009/0267890 | A1* | 10/2009 | Park et al. | 345/102 |
| 2010/0194791 | A1 | 8/2010 | Ogi et al. | |
| 2010/0253696 | A1 | 10/2010 | Choi | |
| 2011/0025728 | A1 | 2/2011 | Baba et al. | |
| 2011/0122168 | A1* | 5/2011 | Lee et al. | 345/690 |
| 2011/0205256 | A1* | 8/2011 | Park et al. | 345/690 |
| 2012/0113164 | A1 | 5/2012 | Furukawa et al. | |

FOREIGN PATENT DOCUMENTS

| | | | |
|---|---|---|---|
| JP | 2009-192753 | A | 8/2009 |
| JP | 2010-152174 | A | 7/2010 |
| JP | 4987134 | A | 5/2012 |
| WO | WO 2011/004520 | A1 | 1/2011 |

* cited by examiner

| | | | |
|---|---|---|---|
| A<br>64 | B<br>224 | C<br>160 | D<br>32 |
| E<br>128 | F<br>192 | G<br>192 | H<br>96 |

| | | | |
|---|---|---|---|
| A<br>64 | B<br>224 | C<br>160 | D<br>32 |
| E<br>128 | F<br>192 | G<br>192 | H<br>96 |

(A)

| | | | |
|---|---|---|---|
| A<br>90 | B<br>220 | C<br>120 | D<br>64 |
| E<br>150 | F<br>110 | G<br>100 | H<br>130 |

(B)

VIDEO DISPLAY DEVICE

This application is a Divisional of application Ser. No. 14/004,864 filed on Sep. 12, 2013, and for which priority is claimed under 35 U.S.C. §120, application Ser. No. 14/004,864 is the national phase of PCT International Application No. PCT/JP2012/056224 filed on Mar. 12, 2012 under 35 U.S.C. §371, which claims the benefit of priority of JP2011-056359 filed Mar. 15, 2011, and JP2011-056355 filed Mar. 15, 2011. The entire contents of each of the above-identified applications are hereby incorporated by reference.

TECHNICAL FIELD

The present invention relates to a video display device, and more particularly to a video display device that divides a backlight into areas to control luminance for each of the areas.

BACKGROUND OF THE INVENTION

Video display devices with use of an LED backlight for illuminating a display panel have been widely used. The LED backlight has an advantage that a local dimming function is available. With the local dimming function, a backlight is divided into a plurality of areas, and light emission of an LED is controlled for each of the areas in accordance with a video signal from a display area corresponding to each of the areas. For example, it becomes possible to perform control so that light emission of an LED is suppressed for a dark part in a screen while light emission of the LED is produced strongly for a bright part in the screen. This makes it possible to reduce power consumption of the backlight and increase contrast in a display screen.

For example, an example of conventional local dimming control is shown in FIG. 26. In the figure, a backlight is divided into eight areas and luminance of an LED is controlled in accordance with a maximum tone value of a video signal corresponding to each of the areas. The maximum tone value of the video signal in each of the areas is provided as shown in FIG. 26(A). The letters A to H denote the numbers of the areas, and the numbers given below them of which indicate the maximum tone values in the respective areas are given in numbers.

For example, the luminance of the LED in the respective areas by local dimming is given as shown in FIG. 26(B). In other words, the luminance of the LED is controlled for each of the areas in accordance with a video signal in each of the areas. In this case, a video is represented relatively dark in an area where a maximum tone value of a video signal is low, and thus the luminance of the LED is lowered so as to reduce generation of black float to increase contrast and power consumption of the LED is sought to be reduced. In this case, the maximum luminance in each of the areas is limited to luminance when all LEDs of the backlight are lighted by the duty ratio of 100% (for example, 450 cd/m$^2$).

Regarding a technology of performing lighting control of a backlight in accordance with an input video signal, for example, Patent Literature 1 discloses a method of controlling a peak luminance level in order to reduce flicker and a moving image blur even when a light emission period is varied over a wide range. In the control method, when setting illumination periods of a display panel whose peak luminance level is varied by controlling a total illumination period length as the total of the illumination periods set within a field period, a light emission mode is determined based on an average luminance level of the entire screen. Then the number, set positions and period lengths of the illumination periods set within one-field period are set under setting conditions prescribed as to the determined light emission mode so as to obtain the peak luminance level set according to input image data.

PRIOR ART DOCUMENT

Patent Documents

Patent Document 1: Japanese Laid-Open Patent Publication No. 2009-192753

SUMMARY OF THE INVENTION

Problem to be Solved by the Invention

As described above, in the conventional local dimming control in which a backlight is divided into a plurality of areas and luminance of an LED is controlled in accordance with a video signal corresponding to each of the areas, maximum luminance in each of the areas is limited to luminance when all LEDs of the backlight are lighted by the duty ratio of 100%, and under the limit, luminance control of the LED is performed in accordance with the video signal. In this case, in an area with a low-tone video signal, when luminance having a noise component as a low-tone component is emphasized by light emission of an LED, noise stands out to cause quality degradation. A user gives attention to a feel of brightness of a high-luminance part, and thus demands ingenuity for video processing that makes a bright video area significantly brighter to further increase a feel of brightness without making the noise stand out.

Further, as described above, in the conventional local dimming control in which a backlight is divided into a plurality of areas and luminance of an LED is controlled in accordance with a video signal corresponding to each of the areas, maximum luminance in each of the areas is limited to luminance when all LEDs of the backlight are lighted by the duty ratio of 100%. Accordingly, for example, local dimming for making a bright video significantly brighter to increase contrast appears to have reached a limit with respect to efficient increase in contrast. Ingenuity has been demanded for providing a high-quality image by further increasing contrast compared to that of a conventional scheme when controlling luminance of an LED by local dimming.

The present invention has been devised in view of circumstances as described above, and an object of the present invention is to provide a video display device that obscures noise in a low-luminance part when a backlight is divided into a plurality of areas and luminance of the backlight is controlled in accordance with a video signal corresponding to each of the areas.

Further, an object of the present invention is to provide a video display device for making a bright video brighter to increase contrast and increasing a feel of brightness of a high-luminance video when a backlight is divided into a plurality of areas and luminance of the backlight is controlled in accordance with a video signal corresponding to each of the areas.

Means for Solving the Problem

To solve the above problems, a first technical means of the present invention is a video display device, comprising: a display panel that displays a video signal; a backlight with use of an LED as a light source for illuminating the display panel; and a control portion for controlling luminance of emitting light of the backlight, the control portion dividing the backlight into a plurality of areas and controls light emission of the LED for each of the divided areas, wherein the control portion decides first luminance of the LED for each of the areas, in accordance with a first feature value of a video in a display area corresponding to each of the divided areas, further decides, for the first luminance for each of the areas, second luminance for each of the areas where the first luminance is uniformly multiplied by a certain multiplying factor within a range where total drive current values of the LED are not greater than a predetermined allowable current value, further compares the second luminance for each of the areas to a predetermined threshold value, and lowers the second luminance again to provide a third luminance, only for an area where the second luminance is lower than the threshold value, and controls light emission of the LED for each of the divided areas by using the third luminance and the second luminance in an area where the second luminance is not lowered.

A second technical means is the video display device of the first technical means, wherein the third luminance for each of the areas agrees with the first luminance in each of the areas.

A third technical means is the video display device of the first technical means, wherein the third luminance for each of the areas falls within a predetermined range including the first luminance in each of the areas.

A fourth technical means is the video display device of the first technical means, wherein the control portion sets the threshold value as a fixed value.

A fifth technical means is the video display device of the first technical means, wherein the control portion sets the threshold value in accordance with a second feature value of a video.

A sixth technical means is the video display device of the first technical means, wherein the control portion sets the threshold value so that the number of areas where the second luminance is lowered to be provided as the third luminance is the predetermined number.

A seventh technical means is the video display device of the fifth technical means, wherein the control portion lowers the second luminance so as to be closer to the first luminance for a video in which the second feature value is smaller when lowering the second luminance according to the threshold value.

An eighth technical means is the video display device of the fifth technical means, wherein the control portion lowers the second luminance so as to be closer to the first luminance for an area video where the second luminance is smaller among areas where the second luminance is lower than the threshold value when lowering the second luminance according to the threshold value.

A ninth technical means is a video display device, comprising: a display panel that displays a video signal; a backlight with use of an LED as a light source for illuminating the display panel; and a control portion that controls luminance for emitting light of the backlight, the control portion divides the backlight into a plurality of areas and controls light emission of the LED for each of the divided areas, wherein the control portion decides, in accordance with a first feature value of a video in a display area corresponding to each of the divided areas, first luminance of the LED for each of the areas, further decides, for the first luminance for each of the areas, second luminance for each of the areas where the first luminance is uniformly multiplied by a certain multiplying factor within a range where total drive current values of the LED are not greater than a predetermined allowable current value, further compares the second luminance for each of the areas to a predetermined threshold value, and only for an area where the second luminance is lower than the threshold value, lowers the second luminance again so as to be equal to the first luminance in the area or so as to fall within a predetermined range of the first luminance to provide a third luminance, allocates the total of decreased luminance in an area having luminance smaller than the threshold value to an area where the second luminance is equal to or more than the threshold value, and increases the second luminance by the allocated luminance to provide a fourth luminance, and controls light emission of the LED for each of the divided areas using the third luminance and the fourth luminance.

A tenth technical means is the video display device of the first technical means, wherein the control portion sets the threshold value as a fixed value regardless of a feature value of a video.

An eleventh technical means is the video display device of the first technical means, wherein the control portion sets the threshold value in accordance with a second feature value of a video.

A twelfth technical means is the video display device of the first technical means, wherein the control portion sets the threshold value so that the number of areas where the second luminance is lowered to be provided as the third luminance is the predetermined number.

A thirteenth technical means is the video display device of the first technical means, wherein the control portion lowers the second luminance so as to be closer to the first luminance for a video in which the second feature value is smaller when lowering the second luminance according to the threshold value, and allocates a relatively larger amount of the luminance for an area where the second feature value is larger when increasing the second luminance according to the threshold value.

A fourteenth technical means is the video display device of the first technical means, wherein the control portion lowers the second luminance so as to be closer to the first luminance for an area where the second luminance is smaller among areas where the second luminance is lower than the threshold value when lowering the second luminance according to the threshold value, and allocates a relatively larger amount of the luminance for an area where the second luminance is larger when increasing the second luminance according to the threshold value.

A fifteenth technical means is the video display device of the first technical means, wherein the control portion distributes equally and allocates the total of decreased luminance in an area having luminance smaller than the threshold value to the area where the second luminance is equal to or more than the threshold value.

A sixteenth technical means is the video display device of the first technical means, wherein the control portion allocates a larger amount of luminance to an area where the second luminance is relatively larger when allocating the total of decreased luminance in an area having luminance smaller than the threshold value to the area where the second luminance is equal to or more than the threshold value.

A seventeenth technical means is the video display device of the first technical means, wherein the control portion allocates a larger amount of luminance to an area where the second luminance is relatively smaller when allocating the total of decreased luminance in an area having luminance smaller than the threshold value to the area where the second luminance is equal to or more than the threshold value.

An eighteenth technical means the video display device of the first or twelfth technical means, wherein the first feature value is a maximum tone value of a video signal in the divided area.

A nineteenth technical means is the video display device of the fifth or fourteenth technical means, wherein the second feature value is an APL of a video.

A twentieth technical means the video display device of the fifth or fourteenth technical means, wherein the second feature value is a maximum tone value for each frame of a video.

Effect of the Invention

According to the present invention that has been devised in view of circumstances as described above, it is possible to provide a video display device that obscures noise in a low-luminance part when a backlight is divided into a plurality of areas and luminance of the backlight is controlled in accordance with a video signal corresponding to each of the areas.

Further, according to the present invention, it is possible to provide a video display device that makes a bright video brighter to increase contrast and increases a feel of brightness of a high-luminance video when a backlight is divided into a plurality of areas and luminance of the backlight is controlled in accordance with a video signal corresponding to each of the areas.

PREFERRED EMBODIMENT OF THE INVENTION

Figure 1:
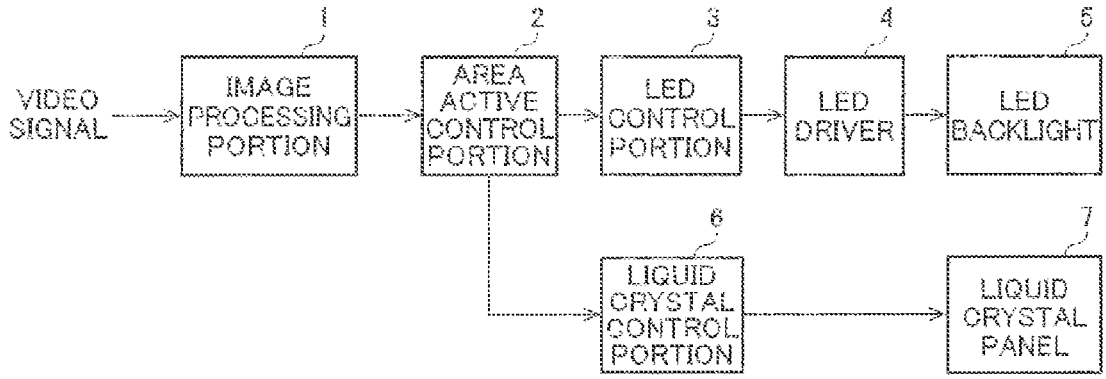
FIG. 1 is a diagram illustrating a partial configuration example of a video display device according to the present invention.

FIG. 1 is a diagram illustrating a partial configuration example of a video display device according to the present invention. The video display device has a configuration for displaying a video by performing image processing with respect to an input video signal and is applicable to a television device and the like.

An image processing portion 1 performs video signal processing as with conventional processing for inputting a video signal separated from a broadcast signal and a video signal input from an external device, and for example, for appropriately executing I/P conversion, noise reduction, scaling processing, γ adjustment, white balance adjustment and the like. Moreover, for output, the image processing portion 1 adjusts and controls contrast, a color tone and the like based on a user setting value.

An area active control portion 2 divides a video signal into predetermined areas in accordance with the video signal that is output from the image processing portion 1 and extracts a maximum tone value of the video signal for each of the divided areas. This maximum tone value for each of the areas is output as LED data to an LED control portion 3. Further, in the area active control portion 2, data indicating a tone of each liquid crystal pixel is output as liquid crystal data to a liquid crystal control portion 6. At the time, the liquid crystal data and the LED data are output so that an LED backlight 5 and a liquid crystal panel 7 are sustainably synchronized as final output destinations.

Note that, although the LED data is a maximum tone value of a video signal for each of the divided areas, the data may be another predetermined statistic such as an average tone value of video signals in the divided area rather than the maximum tone value. A maximum tone value in an area is generally used as LED data, and description will be thus given below assuming that a maximum tone value in a divided area is used.

The LED control portion 3 performs power limit control on LED data that is output from the area active control portion 2 and determines a control value for controlling lighting of each LED of the LED backlight 5. The power limit control is provided for further increasing luminance of a backlight for an area having luminance further required in a display screen to increase contrast, and for increasing luminance for emitting light from the LED up to total drive currents when all LEDs of the backlight are lighted, within a range where the total drive currents of an LED which is lighted in each of the areas do not exceed the total drive currents when all the LEDs are lighted as described above.

The luminance of the LED of the LED backlight 5 may be controlled by PWM (Pulse Width Modulation) control or current control, or combination thereof. In any of these cases, control is performed so that the LED emits light with desired luminance. In the following examples, duty control by PWM is described as an example. A control value that is output from the LED control portion 3 is provided for performing light emission control of an LED for each of the divided areas of the area active control portion 2, and local dimming is thereby realized. The control portions of the present invention correspond to the area active control portion 2 and the liquid crystal control portion 6.

An LED driver 4 performs light emission control of each LED of the LED backlight 5 according to the LED data that is output from the LED control portion 3.

Figure 2:
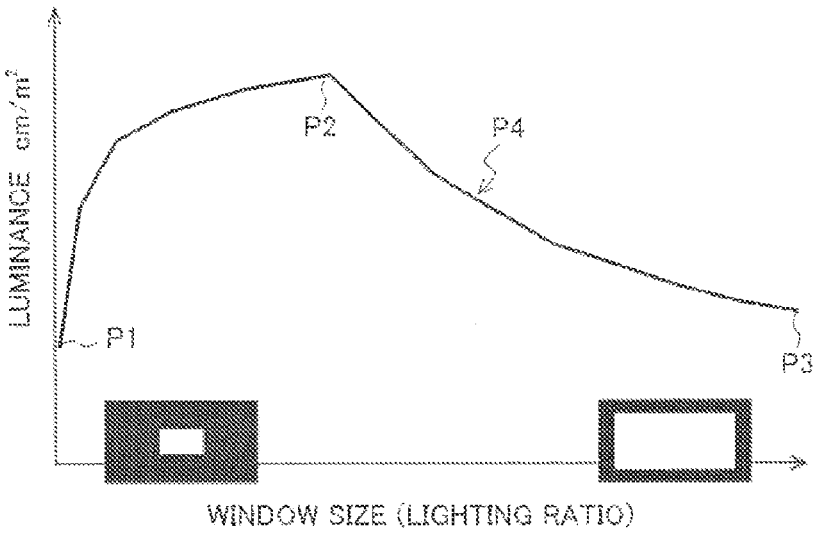
FIG. 2 is a diagram for illustrating an example of setting LED luminance by an LED control portion of the video display device.

FIG. 2 is a diagram for illustrating an example of setting LED luminance by an LED control portion of the video display device.

The LED control portion 3 of the video display device determines the luminance of the LED backlight 5 in relation as shown in FIG. 2. A horizontal axis indicates a lighting ratio (window size) of the backlight. The lighting ratio is provided for deciding an average lighting ratio with respect to the entire backlight, and may be represented as a ratio of a lighting-off area to a full-lighting area (window area). The lighting ratio is zero in a state where there is no lighting area, the lighting ratio is increased as a window of the lighting area becomes larger, and the lighting ratio is 100% when all LEDs are lighted. Further, a vertical axis indicates luminance of an LED in the divided area, and indicates luminance of an LED in an area possibly having a maximum luminance among the plurality of divided areas. In other words, luminance of an area including a window in a screen is indicated.

Power limit control provides constant power for lighting an LED (the total drive current values). Accordingly, as a lighting ratio is increased, power that is allowed to be input to one of the divided areas is decreased.

FIG. 2 shows an example of relation between a lighting ratio and maximum luminance of a divided area. Within a range where the lighting ratio (window size) is small, it is possible to concentrate power on the small window, thus making it possible to light each LED up to a maximum luminance by the duty ratio of 100%. However, in an area where a lighting ratio is small and not all LEDs in a divided area are allowed to be lighted (P1 to P2), even when a lighted LED has the duty ratio of 100%, luminance as the entire area becomes low. In this case, since luminance of the area when the lighting ratio=0 (window size=0) is the lowest and the window size in the area becomes larger as the lighting ratio is increased, luminance of the area is also increased. Accordingly, it is found that a shape of a luminance curve from P1 to P2 is changed also according to the number of divisions of a video (size of the divided area).

When the lighting ratio increases from 0% to the lighting ratio at which all LEDs in one area are allowed to be lighted (P2), the area has maximum luminance. The duty ratio of the LED at the time is 100% because it is possible to power a small area by power limit control.

Further, when the lighting ratio becomes higher from a point P2, LEDs to be lighted increase, and thus each LED is decreasingly powered by power limit control, and accordingly, maximum luminance that is possibly available in the area is gradually decreased. A point P3 indicates a state where the entire screen is fully lighted, and in the case of this example, the duty ratio of each LED is decreased to 36.5%, for example.

Power limit control is provided for further increasing luminance of a backlight for an area where luminance is further required in a display screen to increase contrast. Here, luminance for emitting light from the LED is increased by a certain multiplying factor up to total drive currents when all LEDs of the backlight are lighted, within a range where the total drive currents of an LED which is lighted in each of the areas do not exceed the total drive currents when all the LEDs are lighted as described above.

Figure 3:
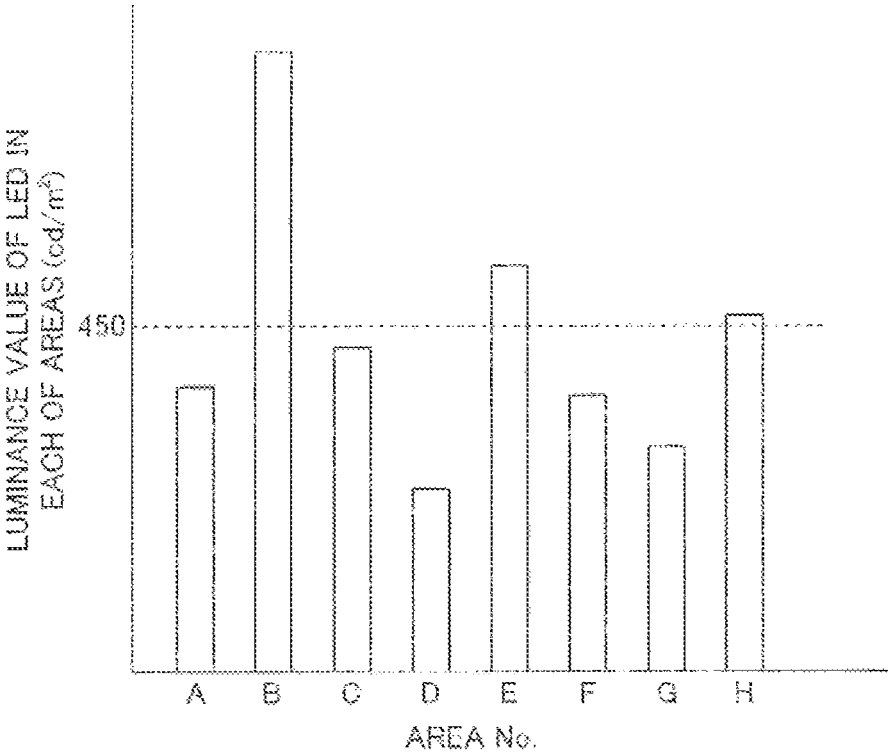
FIG. 3 is a diagram for illustrating an example of local dimming control by power limit control.
Figure 26:
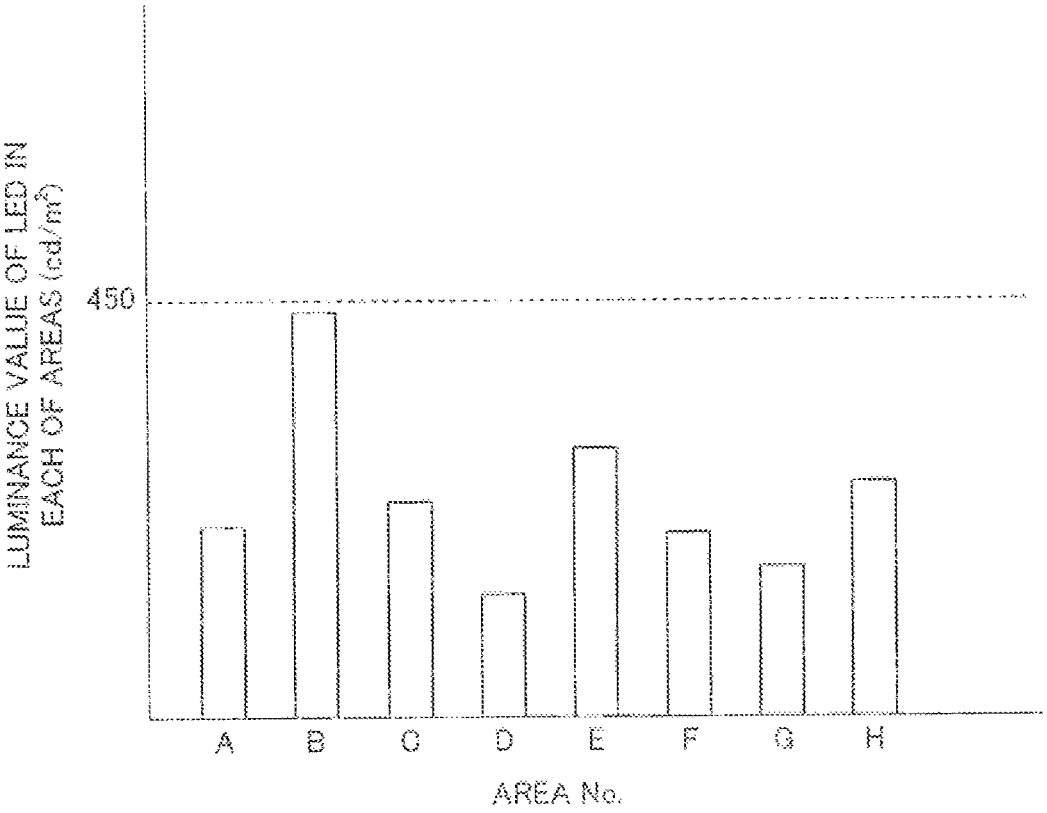
FIG. 26 is a diagram illustrating an example of a conventional local dimming control.

In other words, as shown in FIG. 3, luminance for emitting light from an LED decided for each of the areas in FIG. 26(B) is multiplied by a certain multiplying factor (a times) to increase luminance. A condition at the time is "the total drive current values in each of the areas<the total drive current values when all the LEDs are lighted". In this case, one area is allowed to have luminance exceeding the luminance when all the LEDs are lighted (450 cd/m$^2$, for example), and made brighter by applying more drive currents to the LED within a range having sufficient power. By performing such control, it is possible to actually represent two-to-three-times higher peak luminance.

Embodiment 1

Figure 4:
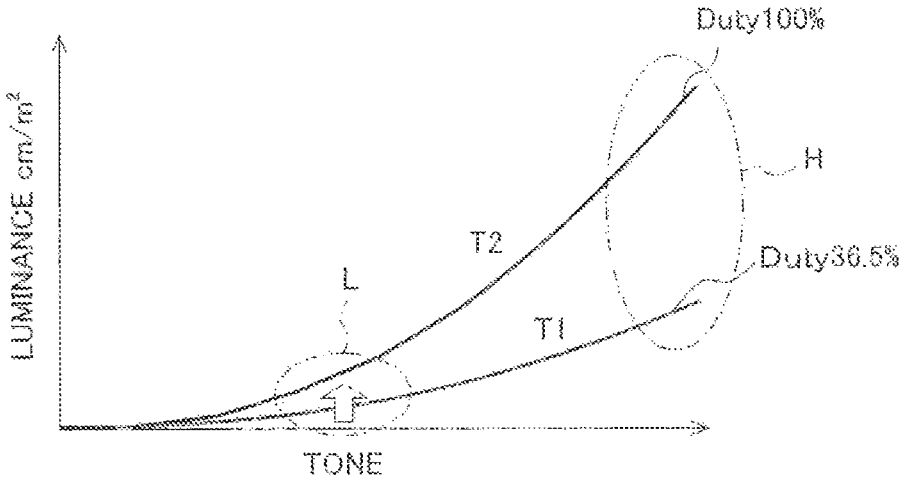
FIG. 4 is a diagram illustrating an example of local dimming by power limit control.

FIG. 4 is a diagram indicating a state of luminance on a liquid crystal panel when luminance duty of an LED is changed. A horizontal axis indicates a tone of a video signal while a vertical axis indicates a luminance value on the liquid crystal panel.

For example, when an LED of an LED backlight is controlled by the duty ratio of 36.5%, gradation expression of a video signal is given as shown by T1. At the time, a luminance value on the liquid crystal panel=(tone value) 2.2 (in other words, gamma=2.2). Here, when the LED is controlled by the duty ratio of 100%, gradation expression is given as shown by T2. In other words, since the luminance of the LED increases by about 2.7 times from 36.5% to 100%, the luminance value on the liquid crystal panel also increases by about 2.7 times. At the time, the luminance increases by about 2.7 times in not only an area H where a feel of brightness of high luminance is desired to be increased, but also a low-tone area L where noise easily stands out by increasing luminance. Accordingly, although contrast of a video is increased, disadvantage by gradually increasing luminance such as black float in a low-tone area is also incurred.

Accordingly, in the first embodiment according to the present invention, light-emission duty of an LED is controlled by power limit control to further reduce luminance of the LED in the low-tone area where screen luminance is not desired to be increased, from a state where duty is uniformly increased within an allowable power range.

Figures 5, 6:
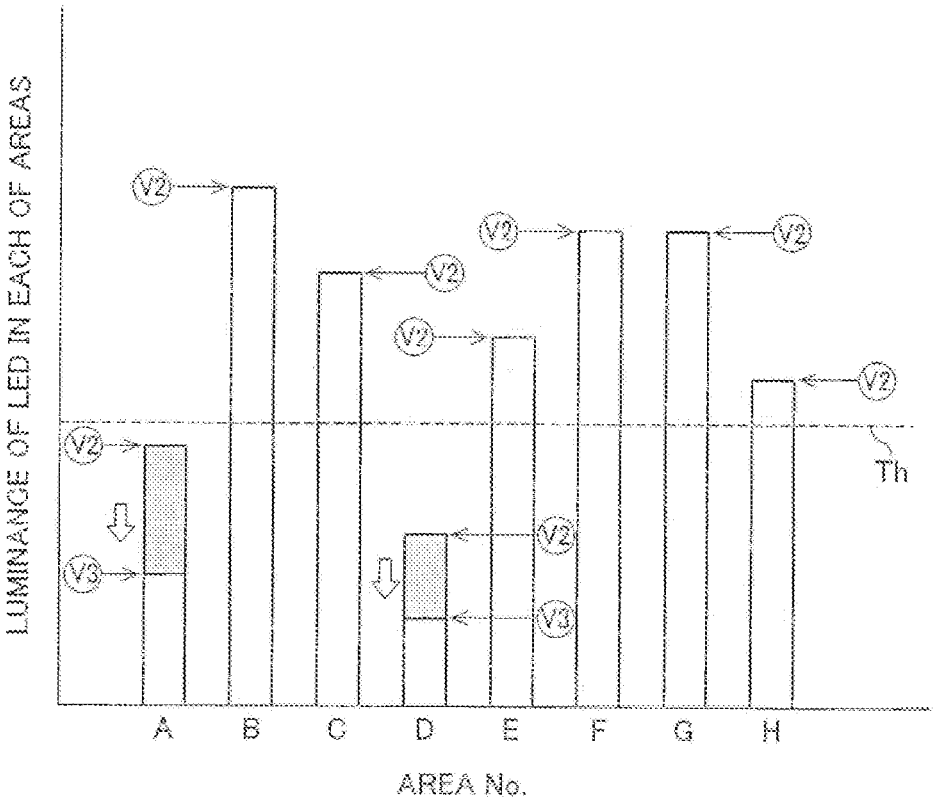
FIG. 5 is a diagram illustrating an example of specific processing by an area active control portion of the video display device.
FIG. 6 is a diagram showing a state where areas shown in FIG. 5 are arranged in an ascending order of area numbers.

Description will be given for an example of specific processing by the area active control portion 2 and the LED control portion 3 according to the present invention. FIG. 5 shows an example of dividing a display screen to eight areas. Numbers of the respective divided areas are given as A to H, and maximum tone values of a video for each of the areas are shown. The maximum tone value corresponds to a first feature value of the present invention. Here, as mentioned above, the first feature value is a maximum tone value for each of the areas, and in addition, another statistic such as an average of tone values in the areas may be used.

In this example, maximum tone values of a video in the eight divided areas are given as 64, 224, 160, 32, 128, 192, 192, and 96, and an average of the maximum tone values is a value of 53% for 256 tones, and in other words, corresponds to a lighting ratio (window size) of 53% in a graph of FIG. 2.

In FIG. 2, it is assumed that the duty ratio of the LED corresponding to luminance of the backlight in an area possibly having a maximum luminance is 55% when the lighting ratio is 53% (P4). In other words, when the lighting ratio is 53% on the screen, luminance of the backlight is allowed to be increased to luminance by the duty ratio of 55% by power limit control, and corresponds to about 1.5 times of luminance by the duty ratio of 38.5% when all the LEDs are lighted (lighting ratio of 100%).

In other words, in the case of having the lighting ratio of 53% with respect to the duty ratio of 38.5% of an LED when all the LEDs are lighted, a lighted LED is allowed to be powered so as to have luminance 1.5 times as much as the duty ratio of 38.5%.

FIG. 6 is a diagram showing a state where areas shown in FIG. 5 are arranged in an ascending order of area numbers. A horizontal axis indicates an area number while a vertical axis indicates a luminance value of an LED in each of the areas. The luminance value of the LED is allowed to be represented as a tone value from 0 to 255 (LED tone), for example.

First, the luminance value of the LED for each of the areas is decided by a method as with the conventional local dimming control method. This luminance is given as first luminance. The first luminance is decided relatively small in an area with a small maximum tone value of a video while decided relatively large in an area with a large maximum tone value of a video (as with FIG. 26(B)). Thereby, as with the conventional method, black float in a low tone is avoided to increase contrast, and power consumption is sought to be reduced, so that luminance in a high-tone area is increased to have an increased feel of brightness. Luminance of an LED in each of the areas at the time is set so as not to exceed screen luminance when all the LEDs are lighted (for example, 450 cd/m$^2$).

Increase in luminance calculated by power limit control as described above (in this case, 1.5 times) is then multiplied by a luminance value of an LED in each of the areas. In this case, a value of the incremental luminance is uniformly multiplied for all the areas. The duty ratio of the LED when all the LEDs are lighted is 36.5% while the luminance of the LED increases to the duty ratio of 55% when the lighting ratio is 53%. A state where the first luminance is multiplied by 1.5 times corresponds to a top position of histogram data in each of the areas shown in FIG. 5. This luminance value is given as a second luminance (V2).

Further, as a feature of the first embodiment according to the present invention, the second luminance (V2) in each of the areas is compared to a predetermined threshold value (LED tone value) Th, and for an area where the second luminance (V2) is smaller than the threshold value Th, the second luminance (V2) is further reduced by a predetermined amount. For example, when the threshold value Th is the 80th tone, the luminance of the LED in an area with the second luminance (V2) smaller than the 80th tone is reduced. A reduction value is assumed to be, for example, 1/1.5=0.68 times. In other words, luminance of 1.5 times (second luminance) an initial luminance value (first luminance) is again multiplied by 0.68 times to provide a third luminance (V3). This results in returning to an original luminance value of the LED (first luminance).

In controlling an LED backlight, the LED is controlled by using the second luminance (V2) in an area where a maximum tone value is the threshold value Th or more. Further, the LED is controlled by using the third luminance (V3) in an area where a maximum tone value is smaller than the threshold value Th. This makes it possible to obscure noise and prevent black float or the like from being increased without excessively increasing the luminance of the LED even when the LED is powered by power limit control in a low-tone video area having a maximum tone value smaller than the threshold value Th.

At the time, by causing the third luminance (V3) to agree with a first luminance, it is possible to return luminance to the first luminance for an area having a maximum tone value smaller than the threshold value even when controlling luminance by limiting power. Such control is an effective countermeasure when even a slight incremental noise amount is problematic because a video has extremely large noise, or on the contrary, has high quality, for example.

Further, as described above, when the first luminance of the LED is uniformly increased to the second luminance by power limit control, and the second luminance is reduced to luminance of the LED in an area having a maximum tone value smaller than the threshold value Th by comparing to the threshold value Th, luminance may be brought close to the first luminance rather than luminance coincided with the first luminance. For example, the third luminance is set so as to fall within a predetermined range of the first luminance. Therefore, the first luminance value is brought close to the third luminance value without coinciding with the third luminance value.

For example, in the above-described example, the first luminance is increased to the second luminance by around 2.7 times when the lighting ratio is 53%. On the other hand, it appears that noise in a video is recognizable by a viewer when luminance increases by 3 dB (1.4 times), and noise stands out when increasing by 6 dB (2 times).

Therefore, in order to obscure noise even in the case of a 2.7-times luminance increase, it is conceivable that the luminance is reduced to twice the original luminance (first luminance). For example, when an increasing rate from the first luminance to the second luminance is 2.7 times by power limit control, for an area having a maximum tone value smaller than a predetermined threshold value, the second luminance is multiplied by 0.74 times to provide the third luminance. The third luminance thereby has a value twice the first luminance. When an increasing rate from the first luminance to the second luminance is not greater than twice, luminance is kept as it is and not further reduced to lower luminance. Further, when noise is further suppressed and incremental luminance in a low-tone area is limited to 3 db, in a case where an increment from the first luminance to the second luminance is 2.7 times, and the second luminance is multiplied by 0.52 times, the third luminance is around 1.4 times the first luminance (3 dB). In this manner, by setting the third luminance within a predetermined range of the first luminance, it is possible to achieve a high-quality video with suppressed noise.

In this manner, in the first embodiment according to the present invention, with respect to the first luminance in which luminance of an LED in a low tone is lowered in order to seek to increase contrast and reduce power consumption based on a maximum tone value (first feature value) in a divided area of a video, the first luminance is increased to the second luminance by powering the LED by power limit control, and the second luminance is compared to a threshold value Th to lower luminance of an LED in an area having a maximum tone value smaller than the threshold value so that third luminance is provided. At the time, the third luminance agrees with the first luminance so that increase of noise by increasing luminance from the first luminance to the second luminance is eliminated.

Further, even when the third luminance is lowered not to the first luminance but to a predetermined range of the first luminance such as around twice the first luminance, it is possible to obtain an effect of obscuring noise. Further, the third luminance may be lowered to luminance lower than the first luminance. In this case, it is possible to further obscure noise in an original video.

Further, when the second luminance is lowered to provide the third luminance, rather than uniformly lowering luminance of the LED by a certain multiplying factor, a multiplying factor of lowering (or a lowering amount of) luminance of the LED may be differentiated in accordance with a value of the second luminance among divided areas having maximum tone values smaller than the threshold value Th. For example, for an area with smaller second luminance among areas having maximum tone values smaller than the threshold value Th, a multiplying factor of lowering luminance of the LED is increased more, or a lowering amount is increased more. At the time, in an area with small second luminance, luminance agrees with the first luminance, or luminance of the LED is lowered to be close to the first luminance, while in an area where the second luminance is relatively large, luminance of the LED is lowered to around twice the first luminance, for example. This makes it possible to obtain an effect of increasing luminance by power limit while suppressing appearance of noise.

Further, among areas having a maximum tone value smaller than the threshold value Th, luminance of the LED may be lowered more so as to be closer to the first luminance as the second feature value (an APL or a maximum tone value of a video) is smaller. For example, for a video with a relatively high APL, in an area having a maximum luminance value smaller than the threshold value, a noise reduction effect can be obtained by, for example, returning luminance of the LED to a predetermined range of around twice the first luminance rather than returning the luminance of the LED to the first luminance. An area with a small APL originally has a lower tone value, and therefore the luminance of the LED is returned to the first luminance to suppress noise. Thereby, in an area with a higher APL, it is possible to prevent noise from standing out while maintaining video expression without excessively suppressing the luminance of the LED. The same applies to the case of using a maximum tone value of a video as the second feature value.

Figure 7:
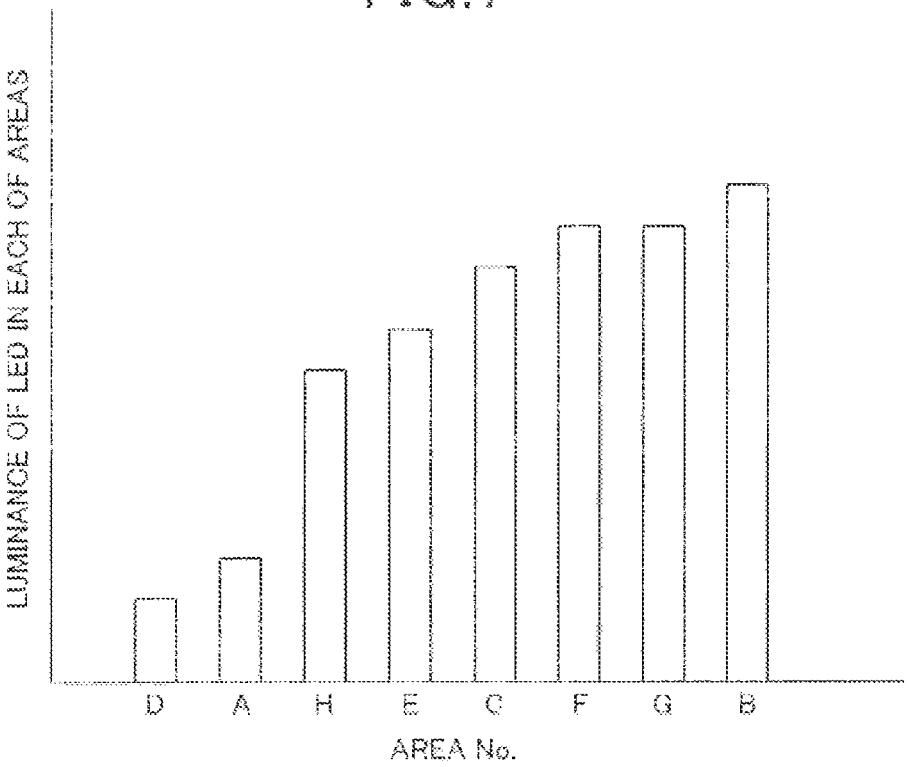
FIG. 7 is a diagram showing a state where luminance of an LED in an area having a maximum tone value smaller than a threshold value Th is lowered and luminance values of the LED are sorted into an ascending order.

As shown in FIG. 6, luminance of an LED in an area having a maximum tone value smaller than the threshold value Th is lowered by employing any of methods as described above. Next, as shown in FIG. 7, obtained luminance values of the LED are sorted into an ascending order. Subsequently, a tone curve is made having a maximum tone value in each of the areas as an input value and luminance of an LED in each of the areas as an output value.

Figure 8:
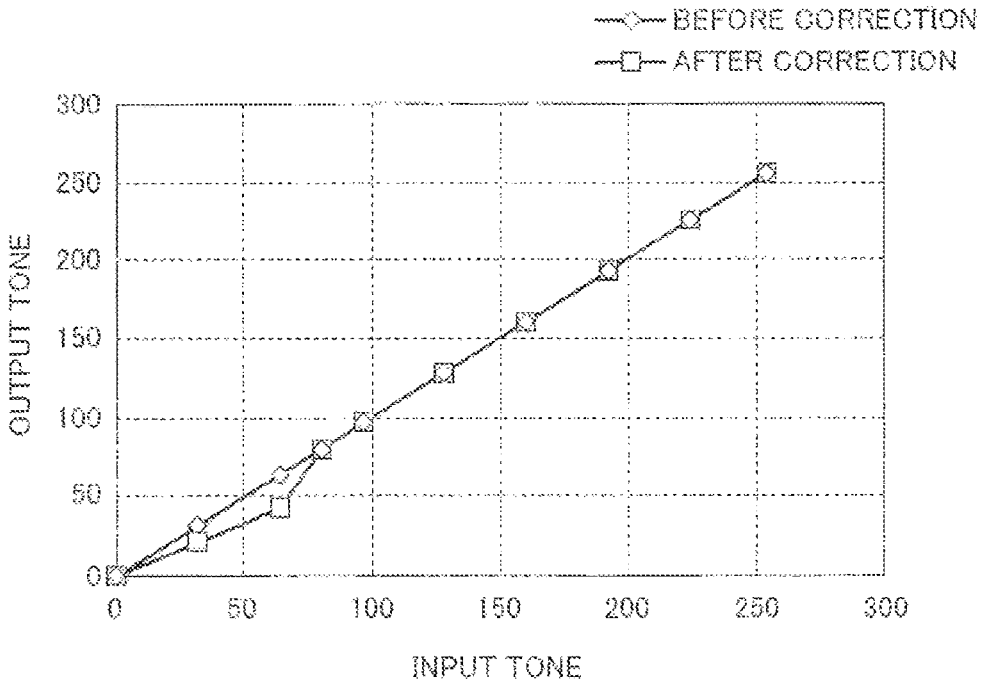
FIG. 8 is a diagram showing an example of a tone curve having a maximum tone value in each of the areas as an input value and luminance of an LED in each of the areas as an output value.

FIG. 8 is a diagram showing an example of the obtained tone curve, where a horizontal axis indicates an LED tone value (input tone) corresponding to the second luminance while a vertical axis indicates an LED tone value (output tone) corresponding to the third luminance. "Before correction" indicates a tone curve when the second luminance is output without being corrected to the third luminance while "after correction" indicates a tone curve when the second luminance is corrected to the third luminance according to the threshold value.

As shown in FIG. 8, in the tone curve after the correction, in the case of an area with a low tone smaller than a predetermined threshold value, control is performed so as to reduce again luminance of an LED whose luminance is increased by power limit. In other words, only for an area with a low tone smaller than a predetermined threshold value, luminance is maintained to the same level as or a level close to that of the original luminance of LED (first luminance) without increasing luminance of the LED. This makes it possible to suppress appearance of noise on display and perform video expression with an increased feel of brightness in a high-luminance area without excessively increasing luminance of the LED only for a predetermined low-tone area.

Further, the above-described threshold value may be decided in accordance with the number of areas where luminance is reduced among divided areas. For example, in only the predetermined number of areas from areas where the maximum tone values are low among a plurality of divided areas, a threshold value is allowed to be set so that the second luminance is reduced to provide the third luminance. For example, the third luminance is set for only two areas among eight divided areas. It is thereby possible to suppress increase in luminance of the LED and to prevent noise from standing out for the predetermined number of low-luminance areas.

Further, the above-described threshold value Th may be dynamically changed in accordance with a feature value of a video. An APL (Average Picture Level), a maximum tone value (peak value) or the like in a video may be used as a feature value. These feature values are given as a second feature value according to the present invention.

Here, as described above, LED data is generally a maximum tone value of a video signal in a divided area. Further, the APL is an average value of luminance of video signals, and generally not an average value in a specific area of a video but an average value in the entire video. Accordingly, the APL dynamically changes for each frame of a video.

For example, it is possible to dynamically change the threshold value Th according to an APL of a video.

Figure 9:
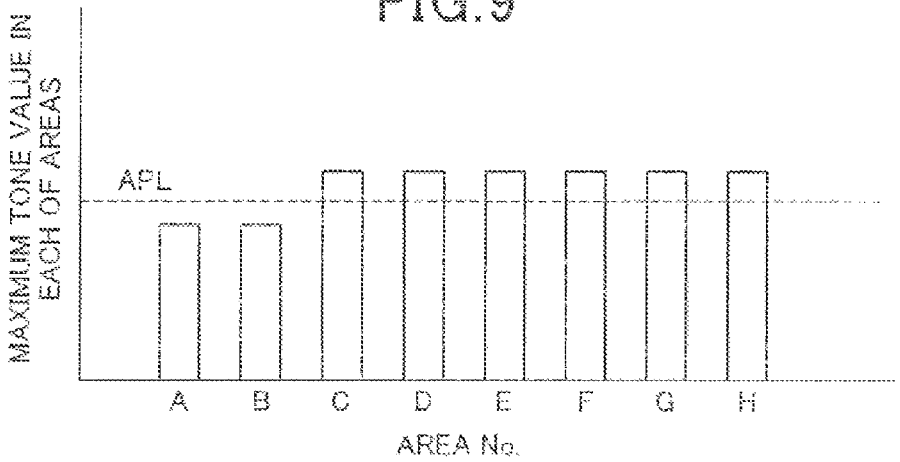
FIG. 9 is a diagram showing an example of a video having relatively small contrast by the APL ratio of 50%.

FIG. 9 is a diagram showing an example of a video by the APL ratio of 50%. A horizontal axis indicates numbers of divided areas while a vertical axis indicates a luminance value of the LED in each of the areas. A top position in histogram data of each of the areas indicates a maximum tone value (first feature value) in each of the areas.

Generally, there is correlation at some level between an APL of a video and a maximum tone value in a divided area, however, there is a large difference therebetween for some videos. For example, when there are many parts with a large difference of luminance in a video, a maximum tone value is larger than an APL value in all the divided areas in some cases.

FIG. 9 shows a video with relatively small contrast, in which the entire video is monotonous and a difference between brightness and darkness of luminance is small. For example, a video inside a room or of a fog is provided as shown in the diagram. In this case, a difference between an APL and a maximum tone value in each of the areas is small.

An APL is an average value of luminance of the entire video, and therefore, an area with a maximum tone value lower than an APL is an area with luminance to be lowered having a small luminous part. Accordingly, for areas of Nos.

A and B, control is performed so as to lower again luminance of an LED whose luminance is increased by power limit. Specifically, for an area having a maximum tone value smaller than the APL of the video, a threshold value is set so that a second luminance value in the area is smaller than the threshold value. A reduction amount is decided in accordance with any of the above-described examples of processing.

Figure 10:
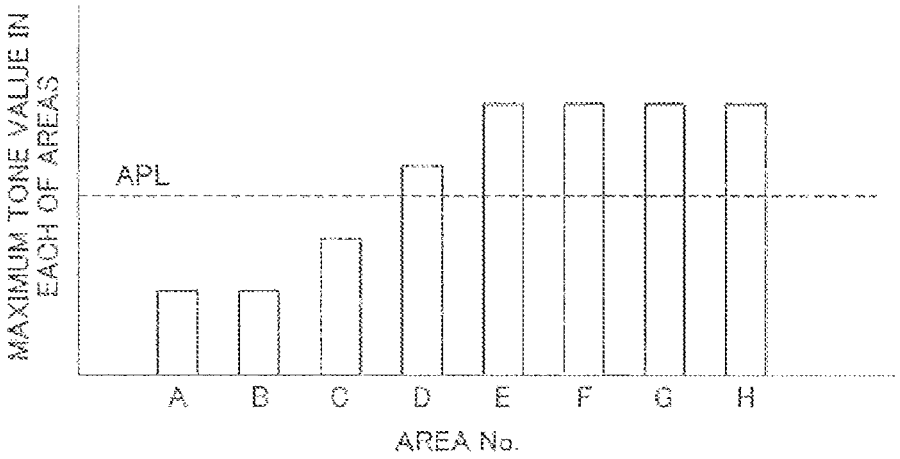
FIG. 10 is a diagram showing an example of a video having relatively large contrast by the APL ratio of 50%.

FIG. 10 shows an example of a video having relatively large contrast with the same APL ratio of 50%. This example shows a common video in which a difference between an APL and a maximum tone value in each of the areas is larger than that of the above-described example in FIG. 7. In the case of setting a threshold value so that luminance of the LED is lowered for an area where a maximum tone value is smaller than the APL, control is performed in the areas of Nos. A to C so as to lower again luminance of an LED whose luminance is increased by power limit.

Figure 11:
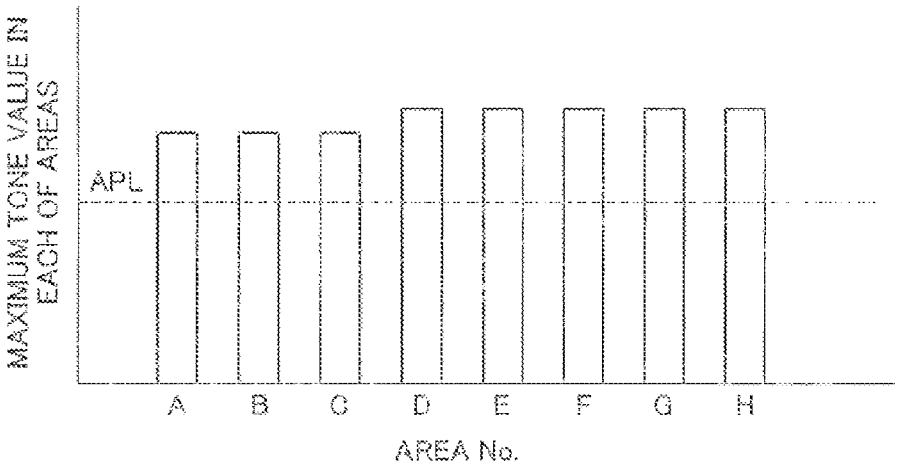
FIG. 11 is a diagram showing an example of a video having extremely large contrast over the entire video by the APL ratio of 50%.

FIG. 11 shows an example of a video having extremely large contrast over the entire video with the same APL ratio of 50%. This example shows a video with considerable sharpness, and such a video is obtained in a case where the outside is imaged over a lattice or many white objects are arranged against a black background, for example. In this case, a maximum tone value is larger than an APL in all areas.

In this case, since the maximum tone value is equal to or more than an APL in all areas, control is not performed for any areas so as to reduce again luminance of an LED whose luminance is increased by power limit. In other words, for an area having a maximum tone value larger than an APL of a video, a threshold value is set so that a second luminance value in the area is equal to or more than the threshold value.

In this manner, the threshold value Th is set for an APL and the threshold value is dynamically changed in accordance with the APL, thereby allowing appropriate luminance control of the LED in accordance with a state of the video.

Further, the threshold value Th may be fixed to a certain value regardless of a state of a video. For example, in FIG. 12 to FIG. 14, regarding videos of FIG. 9 to FIG. 11, 33% of possible luminance is given as a fixed value, and for an area having a maximum tone value smaller than the fixed value, the threshold value is set so as to lower luminance of the LED. In other words, for an area having a maximum tone value smaller than 33% of luminance that a video possibly has, the threshold value is set so that the second luminance value in the area is smaller than the threshold value.

As described above, noise is problematic in a low-luminance area of a video signal when luminance of the LED is increased by power limit. For example, when the entire video signals are classified into high, medium, and low luminance, around 33% or lower of the entire video signals belongs to low-luminance videos. For an area having the value as a maximum tone value, the second luminance is lowered to provide the third luminance, thereby making it possible to perform a control so as to lower again luminance of the LED whose luminance is increased by power limit only for an area having a maximum tone value in low luminance regardless of a state of the entire video.

Figure 12:
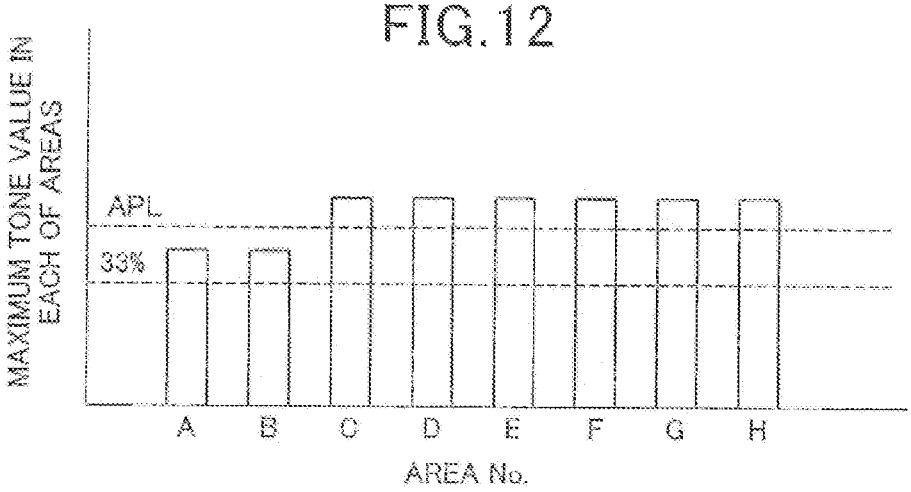
FIG. 12 is a diagram illustrating an example of processing for fixing a threshold value to a certain value regardless of a state of a video.
Figure 13:
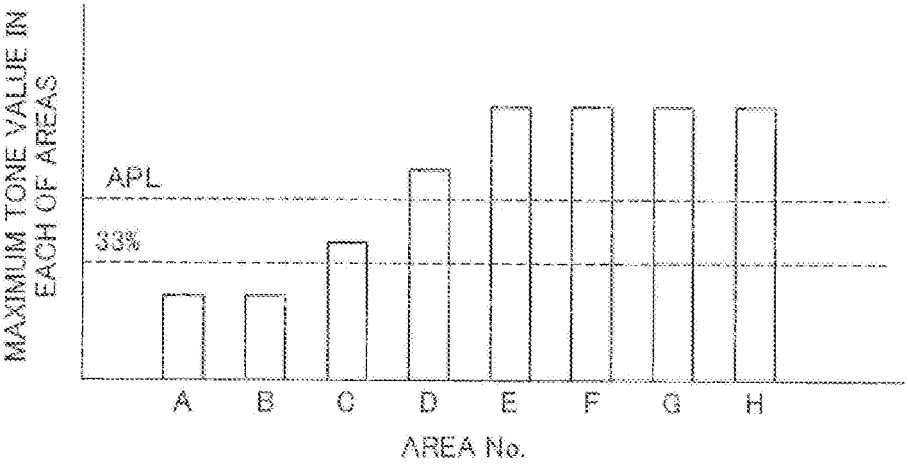
FIG. 13 is a diagram illustrating another example of processing for fixing a threshold value to a certain value regardless of a state of a video.

In the example of FIG. 12, since a maximum tone value in all the areas is equal to or more than a fixed value of 33%, control is not performed for any areas so as to reduce again luminance of an LED whose luminance is increased by power limit. Further, in the example of FIG. 13, control is performed for areas of A and B so as to reduce again luminance of an LED whose luminance is increased by power limit.

Figure 14:
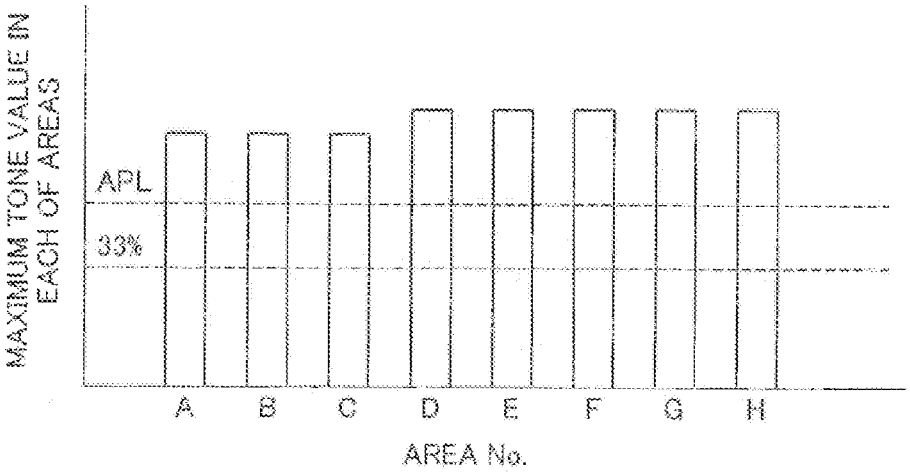
FIG. 14 is a diagram illustrating still another example of processing for fixing a threshold value to a certain value regardless of a state of a video.

Further, in the example of FIG. 14, since maximum tone values in all the areas are equal to or more than a fixed value of 33% as with FIG. 12, control is not performed for any areas so as to reduce again luminance of an LED whose luminance is increased by power limit.

In this manner, a low-tone area where noise is distinctly generated is discriminated by a fixed value of a video signal, and luminance is not increased in a tone area where noise stands out regardless of a state of a video signal, thereby making it possible to always increase a feel of brightness in medium and high-tone parts.

Embodiment 2

Figure 15:
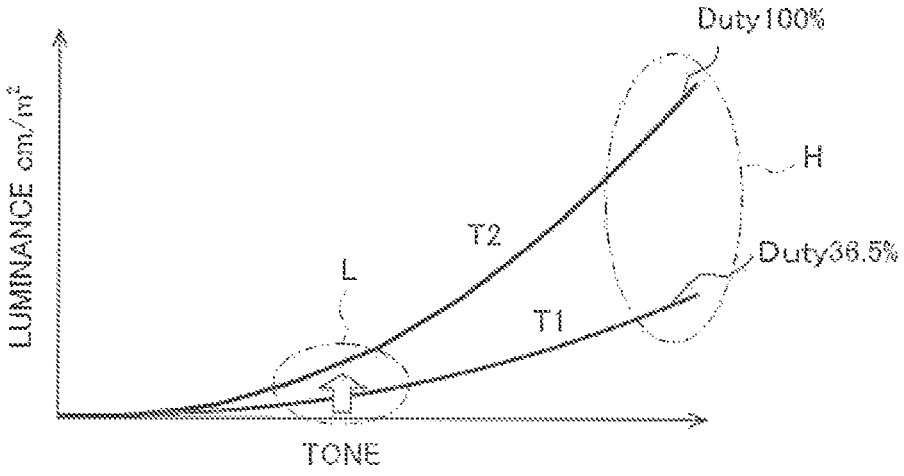
FIG. 15 is a diagram illustrating an example of local dimming by power limit control.

FIG. 15 is a diagram indicating a state of luminance on a liquid crystal panel when luminance duty of an LED is changed. A horizontal axis indicates a tone of a video signal while a vertical axis indicates a luminance value on the liquid crystal panel.

For example, when an LED of an LED backlight is controlled by the duty ratio of 36.5%, gradation expression of a video signal is given as shown by T1. At the time, a luminance value on the liquid crystal panel=(tone value) 2.2 (in other words, gamma=2.2). Here, when the LED is controlled by the duty ratio of 100%, gradation expression is given as shown by T2. In other words, since the luminance of the LED increases by about 2.7 times from 36.5% to 100%, the luminance value on the liquid crystal panel also increases by about 2.7 times. At the time, the luminance increases by about 2.7 times in not only an area H where a feel of brightness of high luminance is desired to be increased, but also a low-tone area L. Accordingly, although contrast of a video is increased, disadvantage by gradually increasing luminance such as black float in a low-tone area is also incurred.

Accordingly, in the second embodiment according to the present invention, light-emission duty of an LED is controlled by power limit control to further reduce luminance of the LED in the low-tone area where screen luminance is not desired to be increased, from a state where duty is uniformly increased within an allowable power range, and further, the reduced luminance is allocated to a high-tone area to increase luminance, thereby making it possible to increase contrast and obtain a high-quality video.

Description will be given for an example of specific processing by the area active control portion 2 and the LED control portion 3 according to the present invention.

Figures 16, 17:
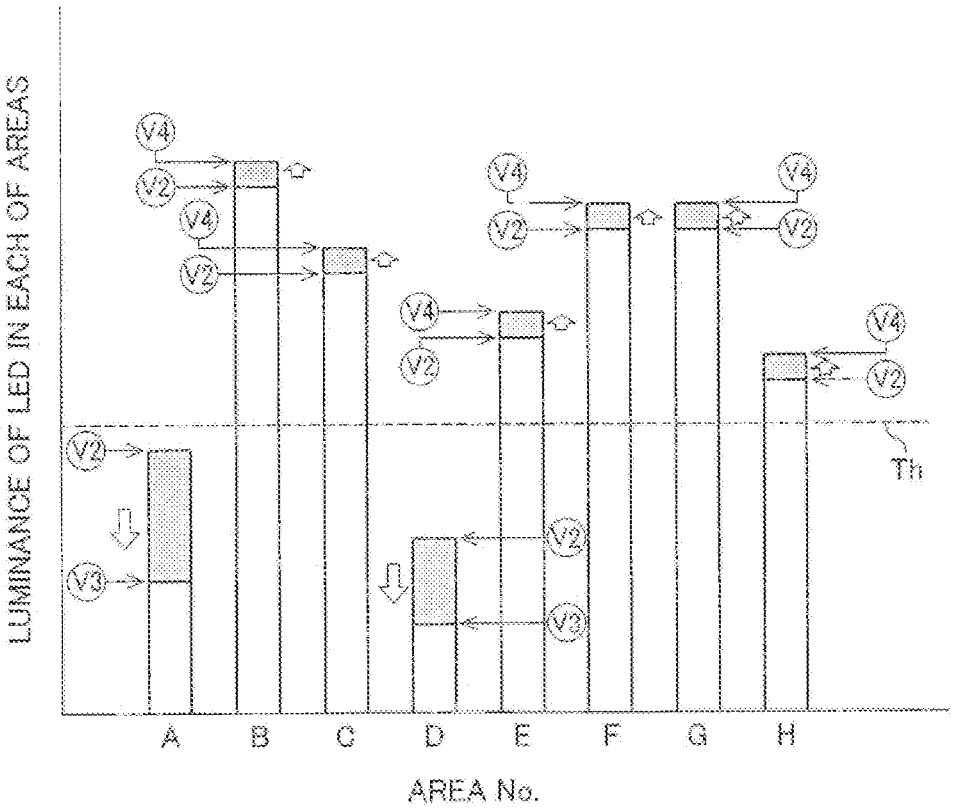
FIG. 16 is a diagram illustrating an example of specific processing by the area active control portion of the video display device.
FIG. 17 is a diagram showing a state where areas shown in FIG. 16 are arranged in an ascending order of area numbers.

FIG. 16 shows an example of dividing a display screen to eight areas. Numbers of the respective divided areas are given as A to H, and maximum tone values of a video for each of the areas are shown. The maximum tone value corresponds to a first feature value of the present invention. Here, as mentioned above, the first feature value is a maximum tone value for each of the areas, and in addition, another statistic such as an average of tone values in the areas may be used.

In this example, maximum tone values of a video in the eight divided areas are given as 64, 224, 160, 32, 128, 192, 192, and 96, and an average of the maximum tone values is a value of 53% for 256 tones, and in other words, corresponds to a lighting ratio (window size) of 53% in a graph of FIG. 2.

In FIG. 2, it is assumed that the duty ratio of the LED corresponding to luminance of the backlight in an area possibly having a maximum luminance is 55% when the lighting ratio is 53% (P4). In other words, when the lighting ratio is 53% on the screen, luminance of the backlight is allowed to be increased to luminance by the duty ratio of 55% by power limit control, and corresponds to about 1.5 times of luminance by the duty ratio of 38.5% when all the LEDs are lighted (lighting ratio of 100%).

In other words, in the case of having the lighting ratio of 53% with respect to the duty ratio of 38.5% of an LED when all the LEDs are lighted, a lighted LED is allowed to be powered so as to have luminance 1.5 times as much as the duty ratio of 38.5%.

FIG. 17 is a diagram showing a state where areas shown in FIG. 16 are arranged in an ascending order of area numbers. A horizontal axis indicates an area number while a vertical axis indicates a luminance value of an LED in each of the areas. The luminance value of the LED is allowed to be represented as a tone value from 0 to 255.

First, the luminance value of the LED for each of the areas is decided by a method as with the conventional local dimming control method. This luminance is given as first luminance. The first luminance is decided relatively small in an area with a small maximum tone value of a video while decided relatively large in an area with a large maximum tone value of a video (as with FIG. 26(B)). Thereby, as with the conventional method, black float in a low tone is avoided to increase contrast, and power consumption is sought to be reduced, so that luminance in a high-tone area is increased to have an increased feel of brightness. Luminance of an LED in each of the areas at the time is set so as not to exceed screen luminance when all the LEDs are lighted (for example, 450 cd/m$^2$).

Increase in luminance calculated by power limit control as described above (in this case, 1.5 times) is then multiplied by a luminance value of an LED in each of the areas. In this case, a value of the incremental luminance is uniformly multiplied for all the areas. The duty ratio of the LED when all the LEDs are lighted is 36.5% while the luminance of the LED increases to the duty ratio of 55% when the lighting ratio is 53%. The first luminance is multiplied by 1.5 times, and the resultant value in histogram data is given as a second luminance (V2).

Further, as a feature of the embodiment according to the present invention, the second luminance (V2) in each of the areas is compared to a predetermined threshold value (tone of LED luminance) Th, and for an area where the second luminance (V2) is smaller than the threshold value Th, the second luminance (V2) is further reduced by a predetermined amount. For example, when the threshold value Th is the 80th tone, the luminance of the LED in an area with the second luminance (V2) smaller than the 80th tone is reduced. A reduction value is assumed to be, for example, 1/1.5=0.68 times. In other words, luminance of 1.5 times (second luminance) an initial luminance value (first luminance) is again multiplied by 0.68 times to provide a third luminance (V3). This results in returning to an original luminance value of the LED (first luminance).

In controlling an LED backlight, the LED is controlled by using the third luminance (V3) in an area where a maximum tone value is smaller than the threshold value Th.

This makes it possible to further increase contrast by maintaining low luminance and prevent black float or the like from being increased without excessively increasing the luminance of the LED even when the LED is powered by power limit control in a low-tone video area having a maximum tone value smaller than the threshold value Th.

At the time, by causing the third luminance (V3) to agree with a first luminance, it is possible to return luminance to the first luminance for an area having a maximum tone value smaller than the threshold value even when controlling luminance by power limit control. Further, as described above, when the first luminance of the LED is uniformly increased to the second luminance by power limit control, and the second luminance is reduced to luminance of the LED in an area having a maximum tone value smaller than the threshold value Th by comparing to the threshold value Th, the third luminance is set so as to be brought close to the first luminance without being conformed to the first luminance and to fall within a predetermined range of the first luminance. For example, the luminance is lowered so as to fall within around twice the first luminance, thereby making it possible to obtain the effect of suppressing appearance of noise that stands out by mainly increasing luminance of a video in a low tone, in addition to the effect of increasing contrast as an object of the present invention.

Further, the total of decreased luminance of an area having luminance smaller than the threshold value is allocated to an area where the second luminance is equal to or more than the threshold value, in which the second luminance is increased by the allocated luminance. In other words, for an area having the second luminance smaller than the threshold value Th, the total luminance lowered from the second luminance is allocated to an area where the second luminance is equal to or more than the threshold value Th. This makes it possible to further increase contrast.

An allocation method described above enables the total of decreased luminance to be equally allotted and allocated to each of the areas. This makes it possible to further clearly display a bright part on a video, which is preferable for a case where a video has a relatively large bright part as in the case of displaying a whitish house.

Further, the allocation method may be provided for changing an allocation ratio in accordance with a second luminance value or a feature value such as an APL.

For example, when the total of decreased luminance of an area having luminance smaller than the threshold value Th is allocated to an area where the second luminance is equal to or more than the threshold value Th, it is possible to allocate larger amount of luminance to an area having a relatively larger second luminance. Luminance of an area including the brightest part is increased intensively, thereby making it possible to further increase a brilliant feel of brightness. This example is preferable for a case where brightness of a bright part and height of luminance is significant rather than emphasizing a tone in the part of fireworks or the like.

Alternatively, when the total of decreased luminance of an area having luminance smaller than the threshold value Th is allocated to an area where the second luminance is equal to or more than the threshold value Th, it is possible to allocate larger amount of luminance to an area having a relatively smaller second luminance. This makes it possible to further clearly display the area including a bright part while preventing appearance of a solid white pattern or gradation loss in a brightest part.

In the example of FIG. 17, equivalent luminance is allocated to areas B, C, E, F, G, and H where the second luminance is equal to or more than the threshold value Th, and the luminance is added to the second luminance. This value is given as fourth luminance (V4). The luminance to be allocated can be represented as a drive current value of an LED. In other words, total drive current values of the decreased luminance are allocated to a drive current value in an area whose luminance is increased to increase the drive current value.

In this manner, in the embodiment according to the present invention, with respect to the first luminance in which luminance of an LED in a low tone is lowered in order to seek to increase contrast and reduce power consumption based on a maximum tone value (first feature value) in a divided area of a video, the first luminance is increased to the second luminance by powering the LED by power limit control, and the second luminance is compared to a threshold value Th to lower luminance of an LED in an area having a maximum tone value smaller than the threshold value so that third luminance is provided. At the time, the third luminance agrees with the first luminance, or lowered to the predetermined range of the first luminance. The decreased luminance in an area having the maximum tone value smaller than the threshold value Th is then allocated to an area where the maximum tone value is equal to or more than the threshold value Th, thereby making a high-luminance area have higher luminance while keeping a dark low-luminance area as-is, and increasing contrast.

Further, when the second luminance is lowered to provide the third luminance, rather than uniformly lowering luminance of the LED by a certain multiplying factor, a multiplying factor of lowering (or a lowering amount of) luminance of the LED may be differentiated in accordance with a value of the second luminance among divided areas having maximum tone values smaller than the threshold value Th. For example, for an area with smaller second luminance among areas having maximum tone values smaller than the threshold value Th, a multiplying factor of lowering luminance of the LED is increased more, or a lowering amount is increased more. At the time, in an area with small second luminance, luminance is brought close to the first luminance to lower the luminance of the LED.

Further, among areas having a maximum tone value smaller than the threshold value Th, luminance of the LED may be lowered more so as to be closer to the first luminance as the second feature value (an APL or a maximum tone value of a video) is smaller. For example, for a video with a relatively high APL, in an area having a maximum luminance value smaller than the threshold value, luminance of the LED is returned, for example, to a predetermined range of around twice the first luminance rather than returning the luminance of the LED to the first luminance. Then, the above-described decreased luminance is allocated to the divided area having a maximum tone value equal to or more than the threshold value Th to further increase the luminance. The smaller the APL is, the larger is the decreased luminance for the area where the maximum tone value is smaller than the threshold value, and total allocation of luminance is thus increased for the area having luminance to be increased, accordingly. Thereby, when the APL is small, it is possible to increase an increment of luminance in a part which is more luminous on a screen to further intensify a feel of brightness and to increase contrast.

The same applies to the case where the maximum tone value of a video is used as a second feature value.

Figure 18:
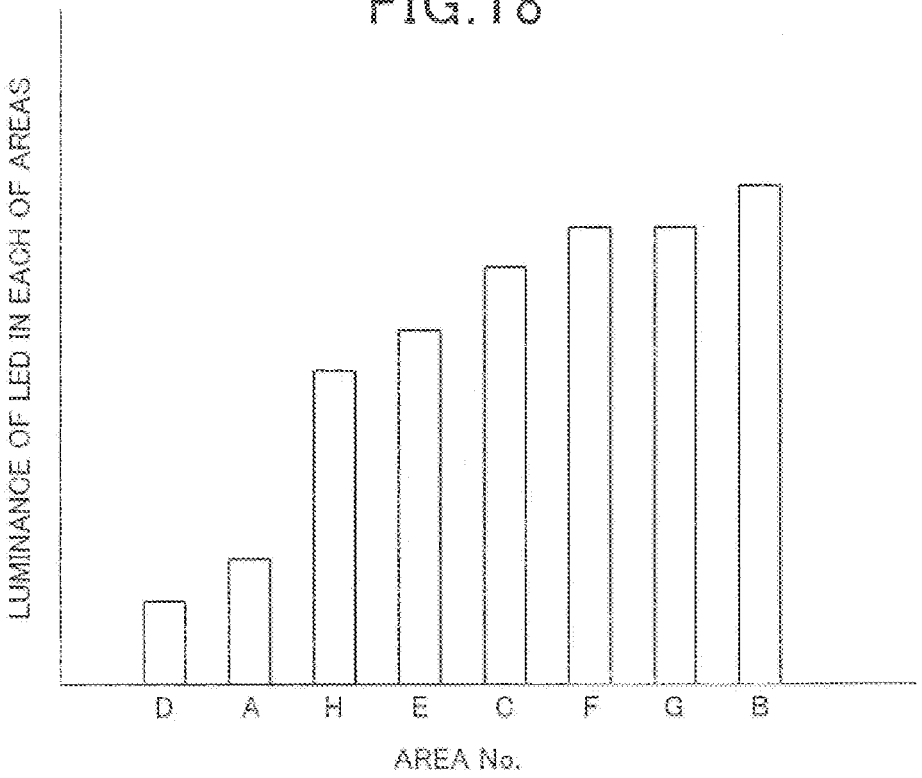
FIG. 18 is a diagram showing a state where luminance of an LED in an area having a maximum tone value smaller than the threshold value Th is lowered and luminance values of the LED are sorted into an ascending order.

As shown in FIG. 17, luminance of an LED in an area having a maximum tone value smaller than the threshold value Th is lowered by employing any of methods as described above. Next, as shown in FIG. 18, obtained luminance values of the LED are sorted into an ascending order. Subsequently, a tone curve is made having a maximum tone value in each of the areas as an input value and luminance of an LED in each of the areas as an output value.

Figure 19:
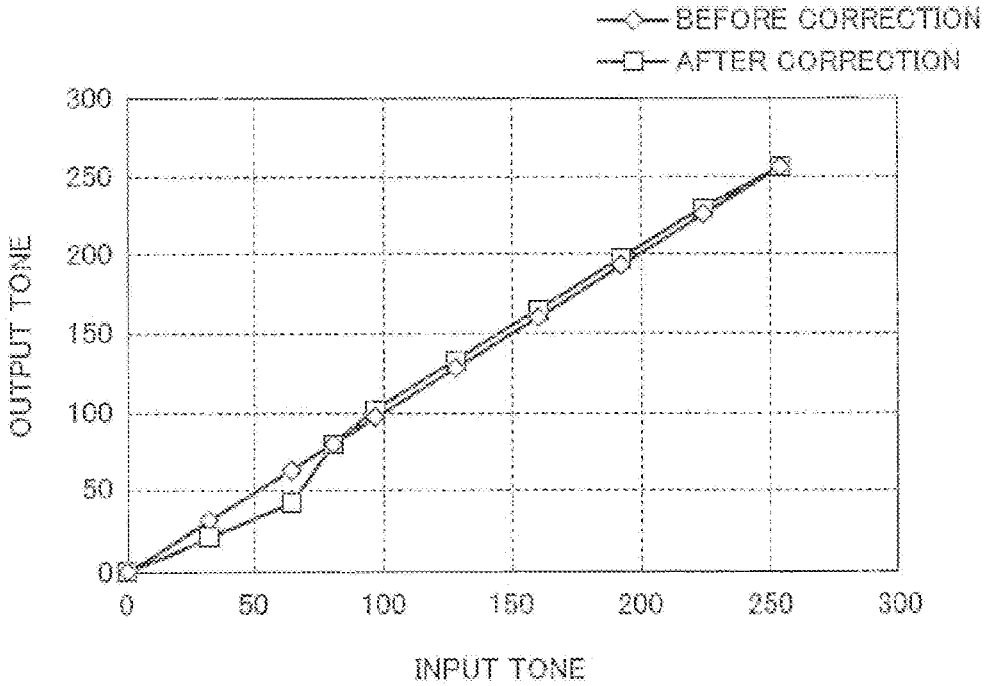
FIG. 19 is a diagram showing an example of a tone curve having a maximum tone value in each of the areas as an input value and luminance of an LED in each of the areas as an output value.

FIG. 19 is a diagram showing an example of the obtained tone curve, where a horizontal axis indicates an LED tone value (input tone) corresponding to the second luminance while a vertical axis indicates an LED tone value (output tone) corresponding to the third luminance. "Before correction" indicates a tone curve when the second luminance is output without being corrected to the third luminance while "after correction" indicates a tone curve when the second luminance is corrected to the third luminance according to the threshold value.

As shown in FIG. 19, in the tone curve after the correction, in the case of an area with a low tone smaller than a predetermined threshold value, control is performed so as to reduce again luminance of an LED whose luminance is increased by power limit. In other words, only for an area with a low tone smaller than a predetermined threshold value, luminance is maintained to the same level as or a level close to that of the original luminance of LED (first luminance) without increasing luminance of the LED. This makes it possible to suppress appearance of noise on display and perform video expression with an increased feel of brightness in a high-luminance area without excessively increasing luminance of the LED only for a predetermined low-tone area.

Further, the above-described threshold value may be decided in accordance with the number of areas where luminance is reduced among divided areas. Here, in only the predetermined number of areas from areas where the maximum tone values are low among a plurality of divided areas, a threshold value is allowed to be set so that the second luminance is reduced to provide the third luminance. For example, the third luminance is set for only two areas among eight divided areas. It is thereby possible to always reduce increase in luminance of the LED and to increase contrast for the predetermined number of low-luminance areas.

Further, the above-described threshold value Th may be dynamically changed in accordance with a feature value of a video. An APL (Average Picture Level), a maximum tone value (peak value) or the like in a video may be used as a feature value. These feature values are given to as a second feature value according to the present invention.

Here, as described above, LED data is generally a maximum tone value of a video signal in a divided area. Further, the APL is an average value of luminance of video signals, and generally not an average value in a specific area of a video but an average value in the entire video. Accordingly, the APL dynamically changes for each frame of a video.

For example, it is possible to dynamically change the threshold value Th according to an APL of a video.

Figure 20:
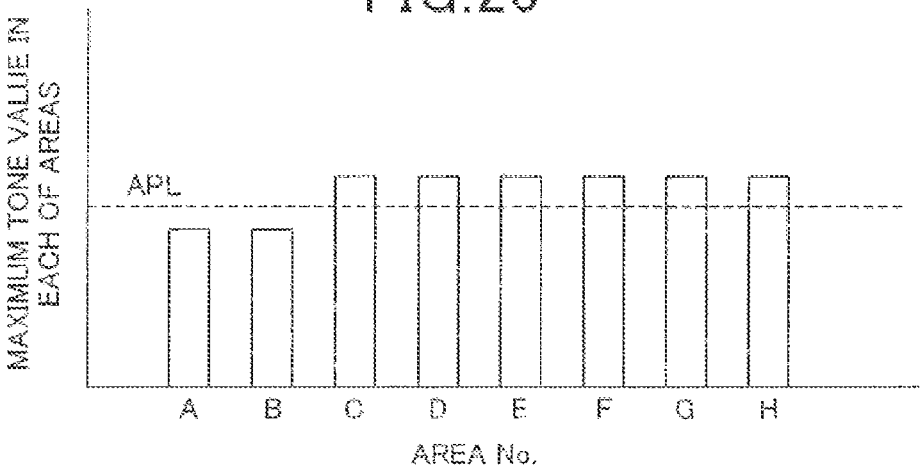
FIG. 20 is a diagram showing an example of a video having relatively small contrast by the APL ratio of 50%.

FIG. 20 is a diagram showing an example of a video by the APL ratio of 50%. A horizontal axis indicates numbers of divided areas while a vertical axis indicates a luminance value of the LED in each of the areas. A top position in histogram data of each of the areas indicates a maximum tone value (first feature value) in each of the areas.

Generally, there is correlation at some level between an APL of a video and a maximum tone value in a divided area, however, there is a large difference therebetween for some videos. For example, when there are many parts with a large difference of luminance in a video, a maximum tone value is larger than an APL value in all the divided areas in some cases.

FIG. 20 shows a video with relatively small contrast, in which the entire video is monotonous and a difference between brightness and darkness of luminance is small. For example, a video inside a room or of a fog is provided as shown in the diagram. In this case, a difference between an APL and a maximum tone value in each of the areas is small.

An APL is an average value of luminance of the entire video, and therefore, an area with a maximum tone value lower than an APL is an area with luminance to be lowered having a small luminous part. Accordingly, for areas of Nos. A and B, control is performed so as to lower again luminance of an LED whose luminance is increased by power limit. Specifically, for an area having a maximum tone value smaller than the APL of the video, a threshold value is set so that a second luminance value in the area is smaller than the threshold value. A reduction amount is decided in accordance with any of the above-described examples of processing. The decreased luminance is reallocated to the area where the maximum tone value is equal to or more than the threshold value, thereby making it possible to increase a feel of brightness in a high-luminance part to increase contrast.

Figure 21:
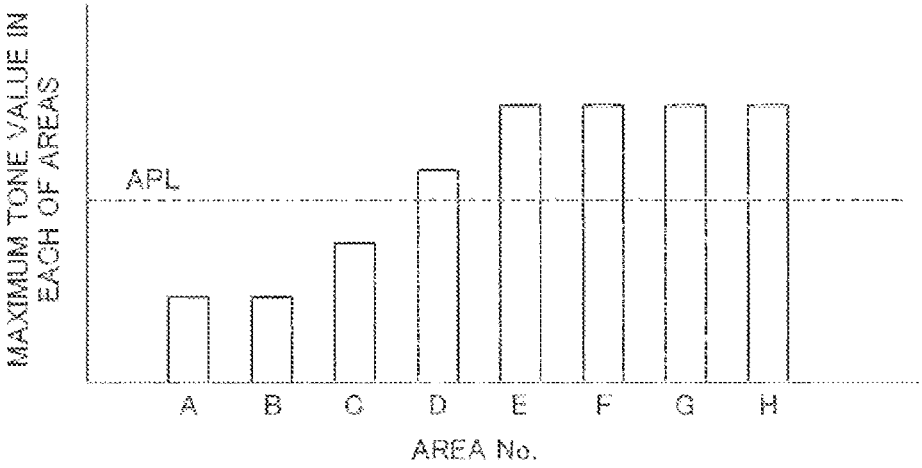
FIG. 21 is a diagram showing an example of a video having relatively large contrast by the APL ratio of 50%.

FIG. 21 shows an example of a video having relatively large contrast with the same APL ratio of 50%. This example shows a common video in which a difference between an APL and a maximum tone value in each of the areas is larger than that of the above-described example in FIG. 20. In the case of setting a threshold value so that luminance of the LED is lowered for an area where a maximum tone value is smaller than the APL, control is performed in the areas of Nos. A to C so as to lower again luminance of an LED whose luminance is increased by power limit. The decreased luminance is reallocated to the area where the maximum tone value is equal to or more than the threshold value.

Figure 22:
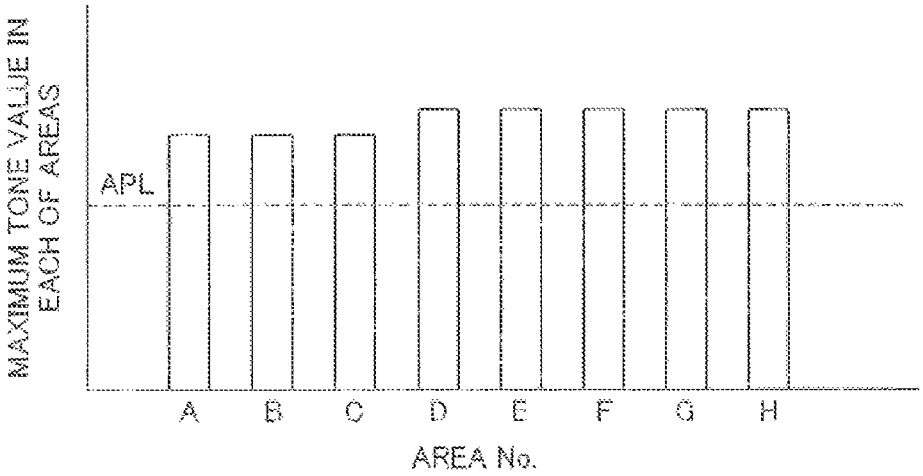
FIG. 22 is a diagram showing an example of a video having extremely large contrast over the entire video by the APL ratio of 50%.

FIG. 22 shows an example of a video having extremely large contrast over the entire video with the same APL ratio of 50%. This example shows a video with considerable sharpness, and such a video is obtained in a case where the outside is imaged over a lattice or many white objects are arranged against a black background, for example. In this case, a maximum tone value is larger than an APL in all areas.

In this case, since the maximum tone value is equal to or more than an APL in all areas, control is not performed for any areas so as to reduce again luminance of an LED whose luminance is increased by power limit. In other words, for an area having a maximum tone value larger than an APL of a video, a threshold value is set so that a second luminance value in the area is equal to or more than the threshold value.

In this manner, the threshold value Th is set for an APL and the threshold value is dynamically changed in accordance with the APL, thereby allowing appropriate luminance control of the LED in accordance with a state of the video.

Further, the threshold value Th may be fixed to a certain value regardless of a state of a video. For example, in FIG. 23 to FIG. 25, regarding videos of FIG. 20 to FIG. 22, 33% of possible luminance is given as a fixed value, and for an area having a maximum tone value smaller than the fixed value, the threshold value is set so as to lower luminance of the LED. In other words, for an area having a maximum tone value smaller than 33% of luminance that a video possibly has, the threshold value is set so that the second luminance value in the area is smaller than the threshold value.

As described above, noise is problematic in a low-luminance area of a video signal when luminance of the LED is increased by power limit. For example, when the entire video signals are classified into high, medium, and low luminance, around 33% or lower of the entire video signals belongs to low-luminance videos. For an area having the value as a maximum tone value, the second luminance is lowered to provide the third luminance, thereby making it possible to perform a control so as to lower again luminance of the LED whose luminance is increased by power limit only for an area having a maximum tone value in low luminance regardless of a state of the entire video.

Figure 23:
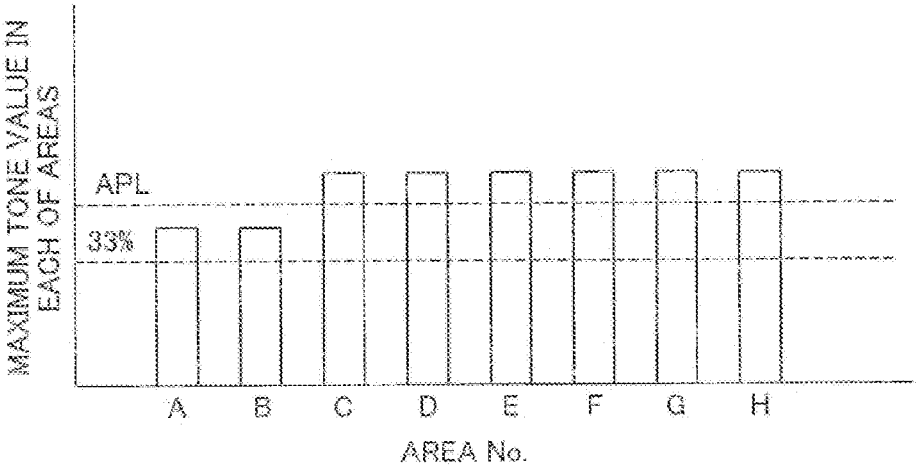
FIG. 23 is a diagram illustrating an example of processing for fixing a threshold value to a certain value regardless of a state of a video.
Figure 24:
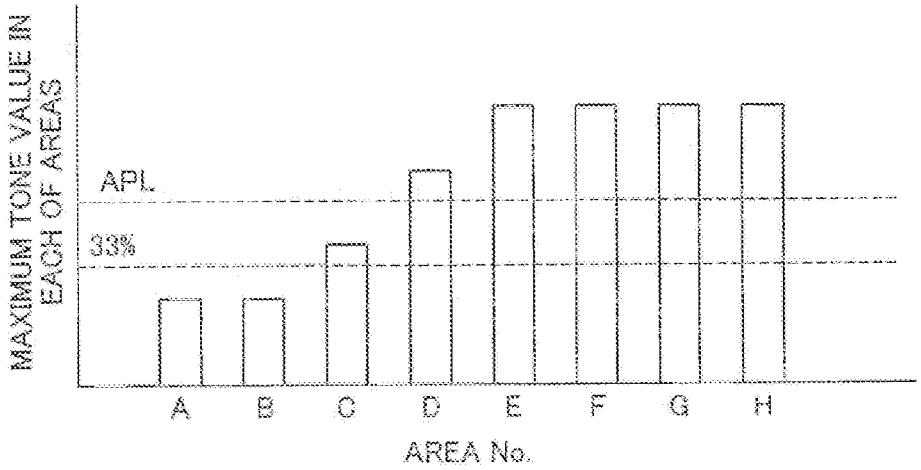
FIG. 24 is a diagram illustrating another example of processing for fixing a threshold value to a certain value regardless of a state of a video.

In the example of FIG. 23, since a maximum tone value in all the areas is equal to or more than a fixed value of 33%, control is not performed for any areas so as to reduce again luminance of an LED whose luminance is increased by power limit. Further, in the example of FIG. 24, control is performed for areas of A and B so as to reduce again luminance of an LED whose luminance is increased by power limit.

Figure 25:
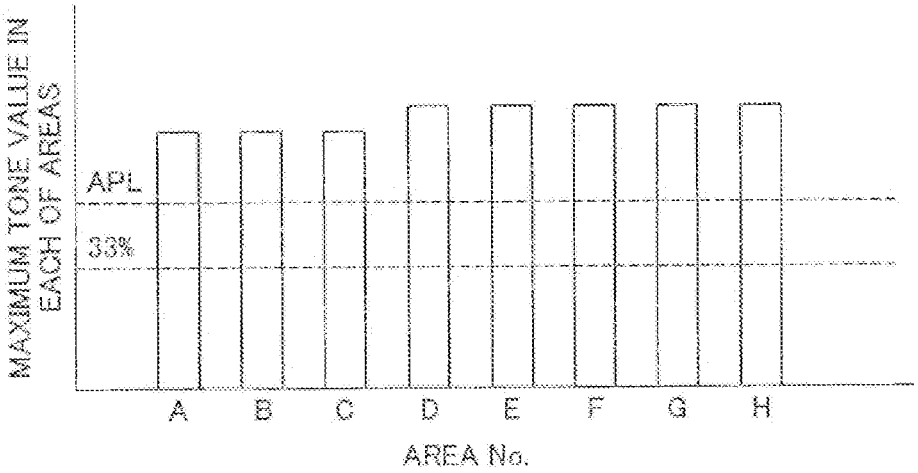
FIG. 25 is a diagram illustrating still another example of processing for fixing a threshold value to a certain value regardless of a state of a video.

Further, in the example of FIG. 25, since maximum tone values in all the areas are equal to or more than a fixed value of 33% as with FIG. 23, control is not performed for any areas so as to reduce again luminance of an LED whose luminance is increased by power limit.

In this manner, a low-tone area where noise is distinctly generated is discriminated by a fixed value of a video signal, and luminance is not increased in a low-tone area regardless of a state of a video signal, thereby making it possible to always increase a feel of brightness in medium and high-tone parts.

EXPLANATIONS OF LETTERS OR NUMERALS

1 . . . image processing portion; 2 . . . area active control portion; 3 . . . LED control portion; 4 . . . LED driver; 5 . . . LED backlight; 6 . . . liquid crystal control portion; and 7 . . . liquid crystal panel.

The invention claimed is:

1. A video display device, comprising:

a display panel that displays a video signal;

a backlight with use of an LED as a light source for illuminating the display panel; and a control portion for controlling luminance of emitting light of the backlight, the control portion dividing the backlight into a plurality of areas and controls light emission of the LED for each of the divided areas, wherein the control portion decides first luminance of the LED for each of the areas, in accordance with a first feature value of a video in a display area corresponding to each of the divided areas, further decides, for the first luminance for each of the areas, second luminance for each of the areas where the first luminance is uniformly multiplied by a certain multiplying factor within a range where total drive current values of the LED are not greater than a predetermined allowable current value, further compares the second luminance for each of the areas to a predetermined threshold value, and lowers the second luminance to provide a third luminance, only for an area where the second luminance is lower than the threshold value, and controls light emission of the LED for each of the divided areas by using the third luminance in the area where the second luminance is lower than the threshold value and the second luminance in an area where the second luminance is not lower than the threshold value.

2. The video display device as defined in claim 1, wherein the third luminance for each of the areas agrees with the first luminance in each of the areas.

3. The video display device as defined in claim 1, wherein the third luminance for each of the areas falls within a predetermined range including the first luminance in each of the areas.

4. The video display device as defined in claim 1, wherein the control portion sets the threshold value as a fixed value.

5. The video display device as defined in claim 1, wherein the control portion sets the threshold value in accordance with a second feature value of a video.

6. The video display device as defined in claim 5, wherein the control portion lowers the second luminance so as to be closer to the first luminance for a video in which the second feature value is smaller when lowering the second luminance according to the threshold value.

7. The video display device as defined in claim 5, wherein the control portion lowers the second luminance so as to be closer to the first luminance for an area video where the second luminance is smaller among areas where the second luminance is lower than the threshold value when lowering the second luminance according to the threshold value.

8. The video display device as defined in claim 5, wherein the second feature value is an APL of a video.

9. The video display device as defined in claim 5, wherein the second feature value is a maximum tone value for each frame of a video.

10. The video display device as defined in claim 1, wherein the control portion sets the threshold value so that the number of areas where the second luminance is lowered to be provided as the third luminance is the predetermined number.

11. The video display device as defined in claim 1, wherein the first feature value is a maximum tone value of a video signal in the divided area.

* * * * *